United States Patent [19]

Allen

[11] Patent Number: 4,659,054

[45] Date of Patent: Apr. 21, 1987

[54] LIGHTWEIGHT CONCRETE FORM HAVING A DETACHABLE EQUIPMENT RAIL

[75] Inventor: J. Dewayne Allen, Paragould, Ark.

[73] Assignee: Allen Engineering Corporation, Paragould, Ark.

[21] Appl. No.: 665,168

[22] Filed: Oct. 26, 1984

Related U.S. Application Data

[63] Continuation-in-part of Ser. No. 101,545, Dec. 10, 1979, abandoned, and a continuation-in-part of Ser. No. 170,126, Jul. 18, 1980, Pat. No. 4,349,294, and a continuation-in-part of Ser. No. 311,674, Oct. 15, 1981, Pat. No. 4,540,312, and a continuation-in-part of Ser. No. 407,620, Aug. 8, 1982, abandoned, and a continuation-in-part of Ser. No. 457,732, Jan. 13, 1983.

[51] Int. Cl.[4] ..... E01C 19/50

[52] U.S. Cl. ..... 249/7; 249/4; 249/6; 249/207; 404/119

[58] Field of Search ..... 249/2–8, 249/207; 404/106, 119; 425/456

[56] References Cited

U.S. PATENT DOCUMENTS

| | | | |
|---|---|---|---|
| 1,909,458 | 5/1933 | Dieckmann | 404/119 |
| 1,918,710 | 7/1933 | Mosel et al. | 249/6 |
| 1,939,007 | 12/1933 | Heltzel | 249/3 |
| 2,799,072 | 7/1957 | Grundy | 249/7 |
| 3,385,552 | 5/1968 | VonDrasek et al. | 249/4 |

FOREIGN PATENT DOCUMENTS

| | | | |
|---|---|---|---|
| 666402 | 9/1938 | Fed. Rep. of Germany | 249/3 |
| 734015 | 7/1955 | United Kingdom | 249/4 |
| 762382 | 11/1956 | United Kingdom | 249/2 |
| 807681 | 1/1959 | United Kingdom | 249/4 |
| 809542 | 2/1959 | United Kingdom | 249/2 |
| 672276 | 7/1979 | U.S.S.R. | 404/114 |

OTHER PUBLICATIONS

Gasciogne four page brochure.

*Primary Examiner*—Jay H. Woo
*Assistant Examiner*—James C. Housel
*Attorney, Agent, or Firm*—Cahill, Sutton & Thomas

[57] ABSTRACT

A concrete form includes a horizontal base and a vertical face joined to the base. Load bearing brackets are coupled at spaced apart intervals along the exterior side of the concrete form to loosely support a detachable equipment rail from below while maintaining the upper surface of the rail parallel to the form base. A rail alignment bracket includes a pair of vertically oriented, spaced apart edges or slots for receiving vertically projecting, spaced apart sides of the equipment rail and maintaining the equipment rail in a fixed position with respect to the form base. A clamping device secures a stake to the load bearing bracket to maintain the concrete form in a fixed position with respect to the subgrade.

20 Claims, 17 Drawing Figures

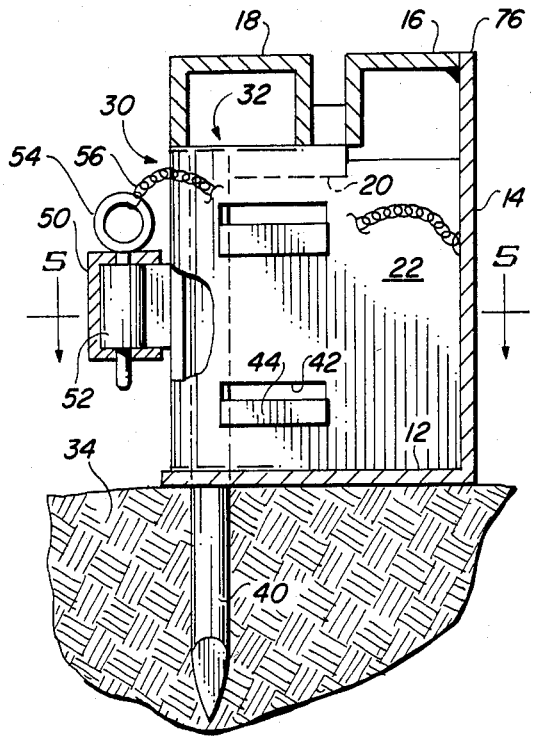
FIG. 3
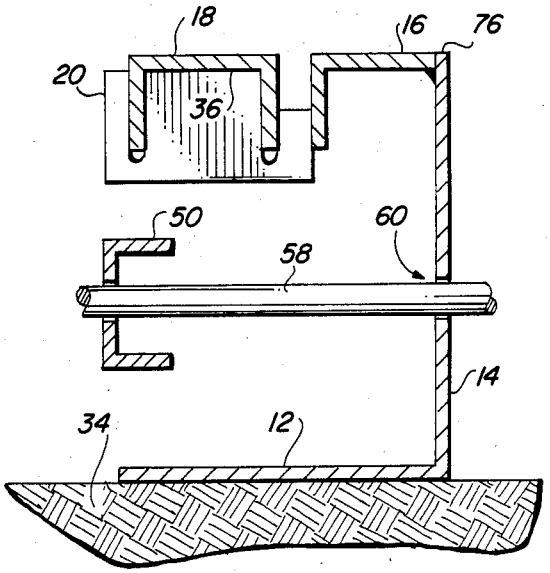
FIG. 4
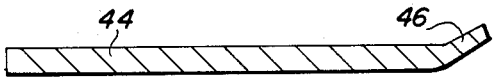
FIG. 6
FIG. 5
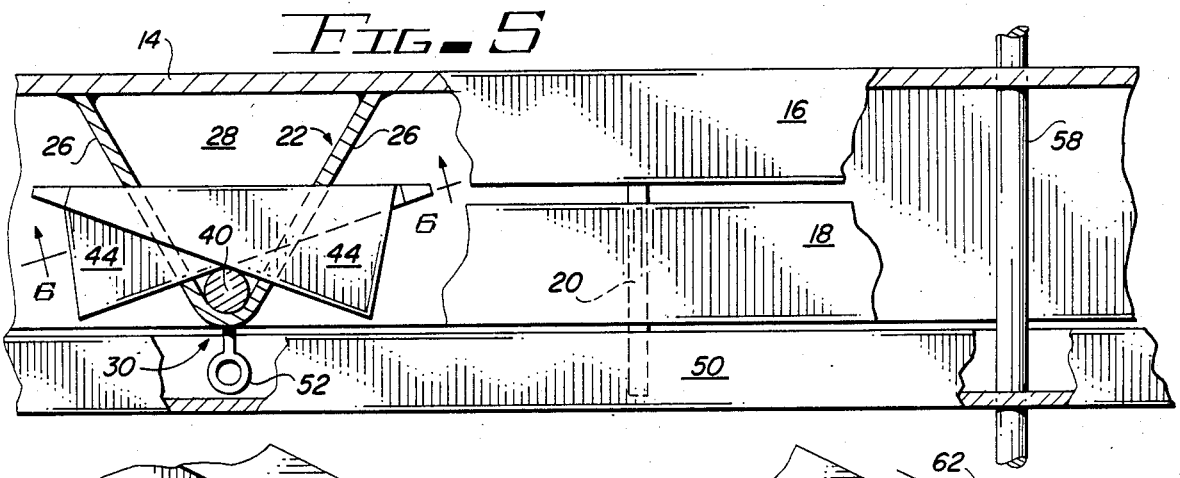
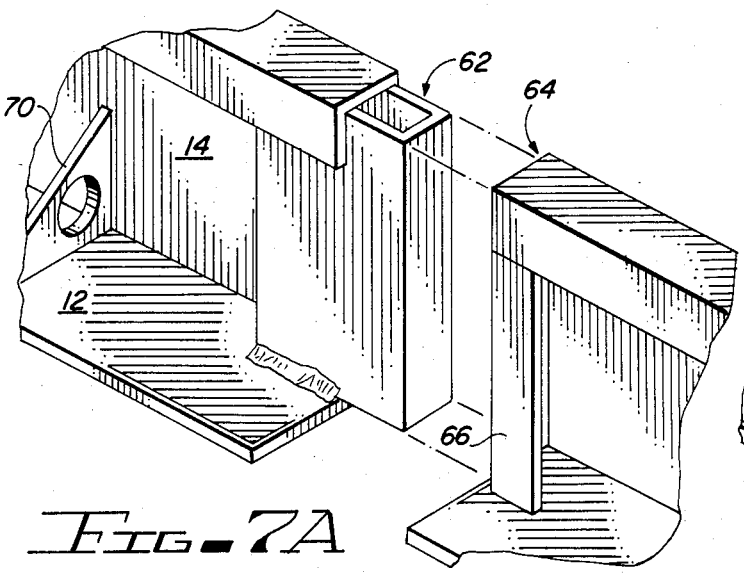
FIG. 7A
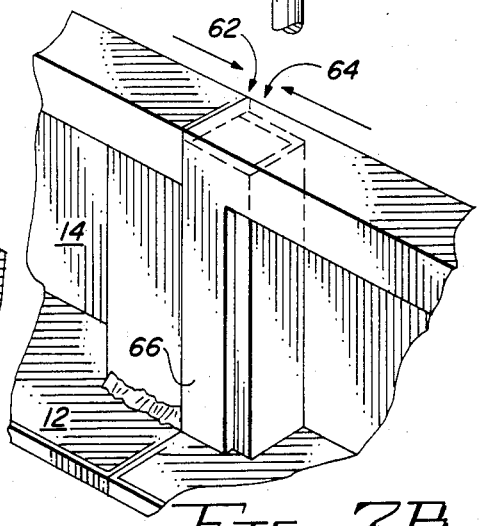
FIG. 7B

LIGHTWEIGHT CONCRETE FORM HAVING A DETACHABLE EQUIPMENT RAIL

This application is a continuation-in-part of the following applications: U.S. patent application Ser. No. 101,545, filed Dec. 10, 1979, now abandoned; U.S. patent application Ser. No. 170,126, filed July 18, 1980, now U.S. Pat. No. 4,349,294; U.S. patent application Ser. No. 311,674, filed Oct. 15, 1981, now U.S. Pat. No. 4,540,312; U.S. patent application Ser. No. 407,620, filed Aug. 8, 1982, now abandoned; and, U.S. patent application Ser. No. 457,732, filed Jan. 13, 1983.

BACKGROUND OF THE INVENTION

1. Field of the Invention

This invention relates to concrete forms, and more particularly, to lightweight metal concrete forms having a separate equipment rail spaced apart from the face of the form.

2. Description of the Prior Art

A variety of concrete forms have been provided to define the boundries of an area of plastic concrete. Gasciogne Engineering Ltd. of Keynshan, England manufactures a sectionalized metal concrete form under the trademark "Atlas." Each section of the Atlas form is joined to an adjacent section by a male/female coupling unit. A plurality of spaced apart, V-shaped brackets are secured to the exterior face of the form and include paired, horizontally oriented apertures for receiving pins which compresiely secure a vertically oriented stake to the apex of a V-shaped channel in the bracket. In an alternative embodiment of the Atlas form, the upper edge of the form face is provided with a highly precise ninety degree edge. A form having a precision ninety degree edge of this type is known in the trade as an Arris form.

Gasciogne Engineering also provides a more complex form known as a Pathfinder MK II form having an Arris form face and a spaced apart equipment rail. The equipment rail is fabricated from thirty-five pound per yard railroad rail which is securely bolted at spaced apart intervals to the upper surface of a plurality of spaced apart brackets. Vertically oriented stakes penetrate through apertures in the base of the form and are positioned in alignment with the apex of V-shaped channels in the brackets. The stakes are secured to the form by horizontally oriented rods which compressively attach the stakes to the brackets. Because of the substantial weight created by the combined heavy duty form and attached thirty-five pound per yard rail, the Pathfinder MK II form must be installed, removed and handled by a crane or other mechanized lifting device. A separate equipment rail is provided since the precision Arris form face is not intended to serve both as a highly precision form edge and as a load bearing surface for receiving potentially damaging impacts and wear from loads imposed by concrete finishing equipment.

SUMMARY OF THE INVENTION

It is therefore a primary object of the present invention to provide a lightweight concrete form having a quickly detachable, lightweight equipment rail loosely coupled to the form to make the form readily man-portable in component parts.

Another object of the present invention is to provide a lightweight concrete form where the stakes which secure the form to the underlying subgrade are positioned immediately below the detachable equipment rail to reduce the required form base width and thereby signficantly lighten the form structure.

Another object of the present invention is to provide a lightweight concrete form where the form is anchored to the subgrade by a plurality of stakes and clamps before the detachable equipment rail is positioned on the form.

Another object of the present invention is to provide a lightweight concrete form which provides a rail alignment bracket to maintain a fixed spacing between the equipment rail and form face and a separate load transfer bracket to transfer loads from the equipment rail to the form face.

Another object of the present invention is to lightweight concrete form incorporating a detachable equipment rail fabricated from a lightweight U-shaped metal channel.

Another object of the present invention is to provide a lightweight concrete form incorporating a high precision Arris form face and a detachable, load bearing equipment rail.

Another object of the present invention is to provide a lightweight concrete form including a detachable equipment rail providing a straight, level, low friction load bearing path immediately adjacent to the edge of an area of plastic concrete.

Briefly stated, an in accord with one embodiment of the invention, a lightweight concrete form includes a horizontal base for contacting an underlying subgrade and a vertical face joined to the base for shaping the edge of an area of plastic concrete. Rail coúpling means loosely couples an equipment rail to the form in alignment with the vertical form face and permits immediate assembly or disassembly of the rail/form unit. The rail coupling means includes spacing means for maintaining a fixed spacing between the equipment rail and the form face and includes first and second inclined sides configured to provide a closely abutting, loose contact with the spaced apart, inclined sides of the equipment rail. The overlap between the equipment rail and the form base defines a rail overlap zone on the base equal in width to the equipment rail width. Load transfer means extends across the rail overlap zone, loosely supports the equipment rail from below, maintains the load bearing surface of the rail parallel to the form base, and transfers loads imposed on the rail to the form base. The form is rigidly secured to the subgrade by the combined interaction of stake penetration means and stake securing means. The stake penetration means enables a plurality of spaced apart stakes to be driven through the form base into the subgrade to secure the stakes to the subgrade. The stake securing means rigidly secures the stakes to the form. The stake penetration means typically takes the form of a bracket coupled to the form and includes a vertically oriented passageway for receiving the stakes. The stake securing means typically takes the form of one or more wedges for compressively securing the stakes to the bracket or to a vertically oriented channel for accomplishing an equivalent objective.

DESCRIPTION OF THE DRAWINGS

The invention is pointed out with particularity in the appended claims. However, other objects and advantages together with the operation of the invention may be better understood by reference to the following detailed description taken in conjunction with the following illustrations, wherein:

FIG. 3 is a sectional view of the form plus equipment rail depicted in FIG. 1, taken along Section line 3—3.

FIG. 4 is a sectional view of the equipment rail depicted in FIG. 1, taken along Section line 4—4. FIG. 4 depicts an alternative rail alignment bracket 20 configuration from that depicted in FIGS. 1 and 3 in that the upper surface of the central section 36 of rail alignment bracket 20 depicted in FIG. 4 actually contacts the lower surface of the equipment rail 18.

FIG. 5 is a partially cutaway plan view of the equipment rail depicted in FIG. 1.

FIG. 6 is an elevational view of a wedge 44 particularly illustrating the turned up wedge locking end 46.

FIGS. 7A–G illustrate the sequence in which the lightweight form plus equipment rail of the present invention is installed prior to commencing a concrete pour.

DESCRIPTION OF THE PREFERRED EMBODIMENT

Figures 1, 2:
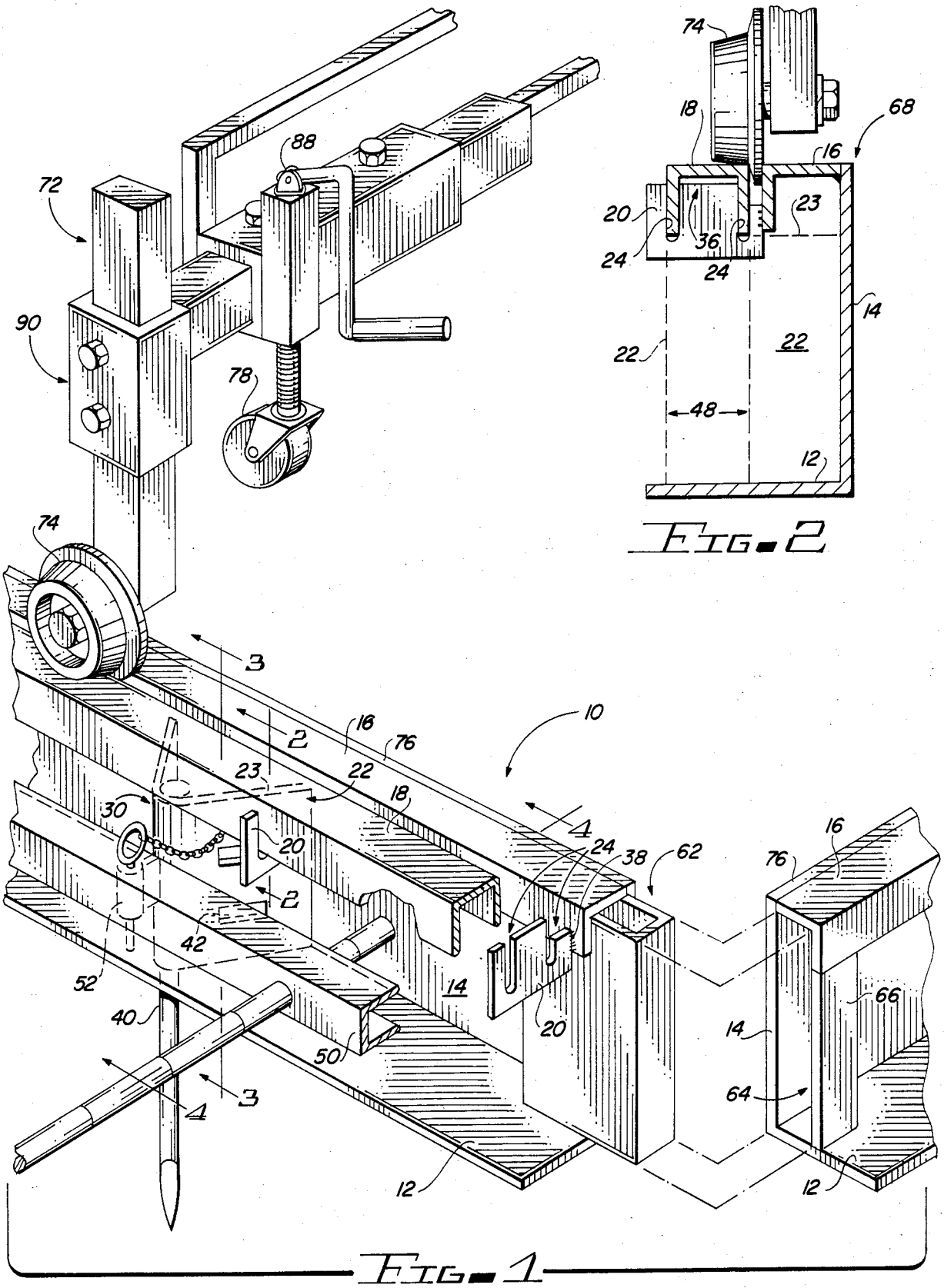
FIG. 1 is a partially cutaway perspective view of a preferred embodiment of the concrete form and equipment rail of the present invention particularly illustrating the manner in which a material spreader system bridge is coupled to, guided by, and supported by the form equipment rail.
FIG. 2 is a sectional view of the form plus equipment rail depicted in FIG. 1, taken along Section line 2—2.

In order to better illustrate the advantages of the invention and its contributions to the art, a preferred hardware embodiment of the invention will now be described in detail.

Referring now to FIGS. 1–5, a concrete form 10 includes a horizontal base 12 and a vertical face 14. An inverted "L"-shaped channel section 16 is spot welded to the upper interior edge of vertical face 14 at spaced apart intervals along the length of the form. An equipment rail 18 is fabricated from a length of U-shaped channel stock having first and second vertically oriented, spaced apart sides joined to a horizontally oriented load bearing upper surface.

Equipment rail 18 is detachably coupled to concrete form 10 by rail coupling means consisting of spacing means or rail alignment bracket 20 and load transfer means or load bearing bracket 22. Rail alignment bracket 20 includes first and second vertically oriented, spaced apart slots designated by arrows 24. The width of slot 24 slightly exceeds the width of each side of equipment rail 18 to provide a loose coupling between equipment rail 18 and rail alignment bracket 20. Load bearing bracket 22 includes first and second vertically oriented, angled sides 26 with ends joined to form face 14 and a lower surface joined to form base 12. The sides 26 of load bearing bracket 22 converge to define a V-shaped channel 28 having an apex designated by reference number 30. The lower edges of the sides of equipment rail 18 contact and are supported by the upper surface 32 of load bearing bracket 22 as best illustrated in FIG. 3

Since the upper surface 23 of bracket 22 supports the weight of equipment rail 18 and the loads imposed on that rail, it is not necessary to design rail alignment bracket 20 to support any vertically oriented loads imposed by equipment rail 18. To avoid the transfer of vertical loading forces to rail alignment bracket 20, the upper surface of the bracket central section 36 may be configured such that an open space or gap is maintained between that section and the lower surface of equipment rail 18. In addition, slots 24 are dimensioned to maintain a gap between rail alignment bracket 20 and the lower end surfaces of equipment rail 18. Since the side to side vertical sliding contact between the equipment rail 18 and the rail alignment bracket 20 transfers only horizontally oriented force vectors, rail alignment bracket 20 can be coupled to channel section 16 by a comparatively weak tack weld as indicated by reference number 38.

In the slightly modified alternative embodiment of rail alignment bracket 20 depicted in FIG. 4, the central section 36 can be configured to contact the lower central surface of equipment rail 18 to provide a vertical force vector transfer capability.

Referring now to FIGS. 1, 5, 7C and 7D, the means for securing concrete form 10 to the underlying subgrade 34 will now be described in detail. An aperture for receiving a stake 40 is disposed in the base 12 in a position aligned with the apex 30 of the load bearing bracket 22. During form installation, stake 40 is positioned within the apex 30 of V-shaped channel 28 and is driven by a hammer into the subgrade 34 until the upper surface of the stake is displaced to a level even with or below the upper surface of load bearing bracket 22.

Figure 7C:
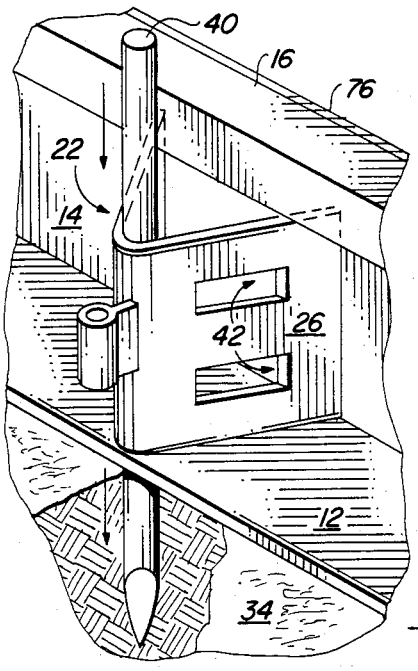
Figure 7D:
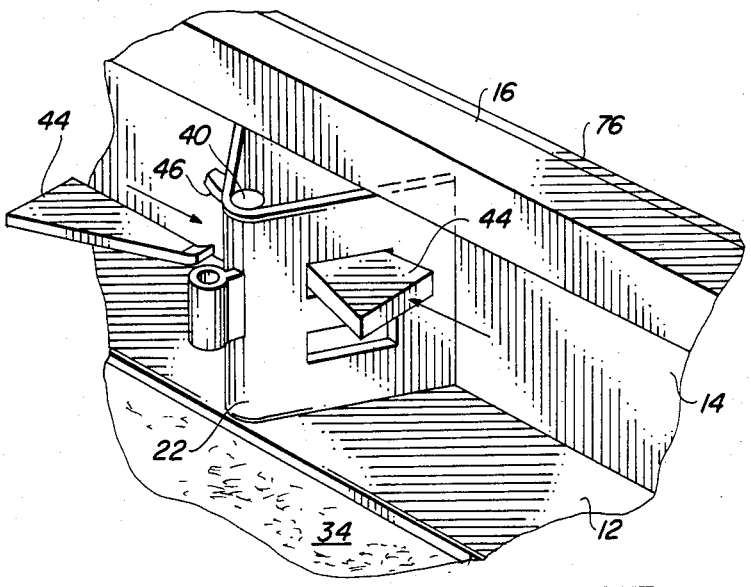

The sides 36 of load bearing bracket 22 include upper and lower paired apertures 42 for receiving opposing wedges 44 as depicted in FIGS. 7C and 7D. FIG. 6 illustrates that the narrowed tip of each wedge 44 includes an upturned end 46 which prevents wedges 44 from becoming detached from load bearing bracket 22 when the wedges are not driven against stakes 40. Stake 40 is rigidly clamped to the apex of load bearing bracket 22 by hammering opposing wedges 44 toward stake 40 to secure form 10 to stake 40.

Figure 7E:
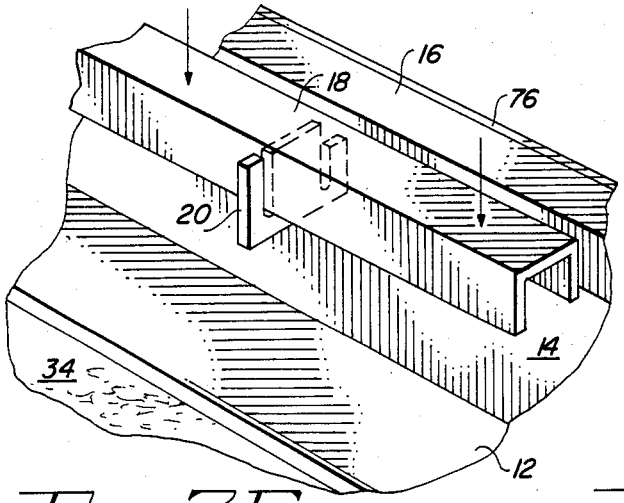
Figure 7F:
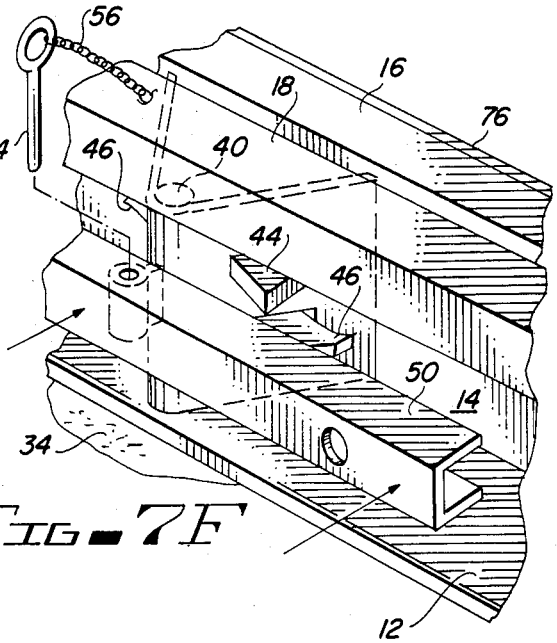
Figure 7G:
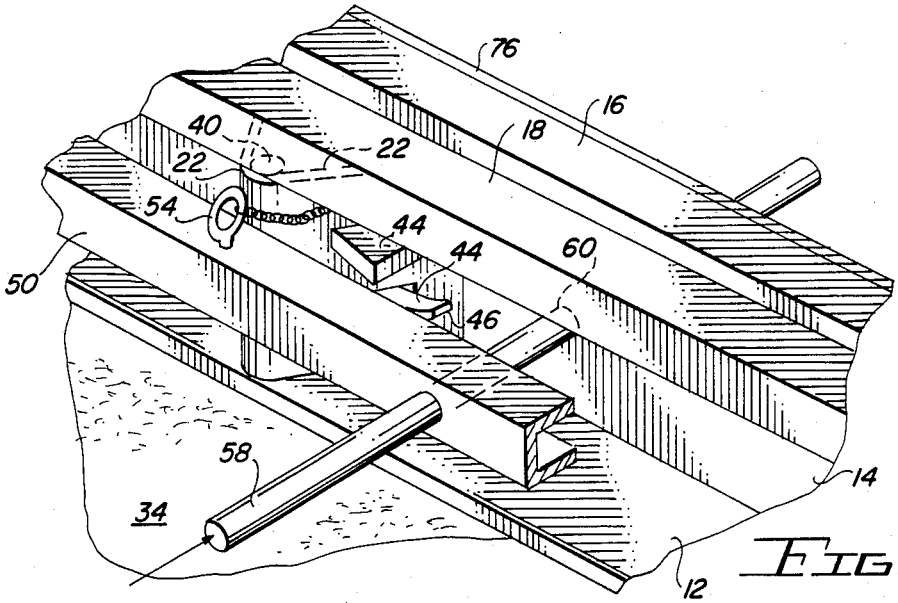

After the upper surface of stake 40 has been driven to a position level with or below the upper surface of load bearing bracket 22 and the wedges 44 have been driven against the stakes, equipment rail 18 is attached to form 10 by aligning the sides of equipment rail 18 with the slots 24 of rail alignment bracket 20 and then dropping the rail into position as indicated in FIG. 7E. The unique structure described above provides a closely abutting, loose contact between the sides of equipment rail 18 and the sides of the slots 24 of rail alignment bracket 20. The upper surface of load bearing bracket 22 loosely supports equipment rail 18 from below.

As illustrated in FIG. 2, the overlap between equipment rail 18 and the base 12 of form 10 defines a rail overlap zone on base 12 as indicated by the dimension line designated by reference number 48. In the lightest weight embodiment of the invention, stake 40 and apex 30 of load bearing bracket 22 will typically be positioned either within or in close proximity to the outer boundry of rail overlap zone 48. This specific design constraint reduces the weight of form 10 by reducing the width of base 12 and the size of load bearing bracket 22. This unique weight saving structure of the present invention requires that equipment rail 18 be detached from form 10 to permit installation of stake 40 to secure form 10 to the underlying subgrade. Only after the upper surface of stake 40 has been driven below the upper surface of load bearing bracket 22 and then securely coupled to that bracket by wedges 44 can equipment rail 18 subsequently be installed on form 10.

In certain applications, it is desirable to insert one-half of a short length of rebar or dowel bar into the edge of an area of plastic concrete. Completion of a subsequent pour on an adjacent section of concrete covers the remaining exposed half of the bar and provides a reinforced coupling between the two adjacent pours. To accommodate this edge reinforcement technique, a horizontally oriented bar support bracket 50 may be coupled to the exterior edge of load bearing bracket 22 by a bracket retainer 52 as depicted in FIGS. 1, 3 and 5. A retainer pin 54 is inserted through vertically aligned apertures in the upper and lower surfaces of bar support bracket 50 and in the cylindrical bore of bracket retainer 52 to detachably secure bracket 50 to concrete form 10. A lightweight chain 56 couples pin 54 to form 10 to prevent loss of the pin. As illustrated in FIG. 4, a bar 58 is inserted through a horizontally oriented aperture 60 in bar support bracket 50 and through an aligned aperture in the vertical face 14 of form 10 until the desired length of bar 58 extends into the pour area. After the freshly poured plastic concrete is cured, bar support bracket 50 is removed from form 10 and the form is laterally displaced away from the edge of the cured concrete surface. Bar 58 remains in a fixed position and slides through aperture 60 of form 10 as the form is pulled away from the edge of the cured concrete.

As illustrated in FIGS. 1, 7A and 7B, the ends of each section of concrete form 10 include either a male coupling unit 62 or a female coupling unit 64. Female coupling unit 64 is dimensioned to receive male coupling unit 62 and includes a vertically oriented metal plate 66 welded to the lower surface of channel section 16 and to the upper surface of the form base 12. Coupling devices 62 and 64 permit adjacent form sections to be readily connected and disconnected to provide the desired form length. The form sections may be manufactured in different lengths to accommodate specific pour dimensions.

FIG. 7A illustrates that a gusset 70 may be welded at spaced apart intervals to the base/face intersection at spaced apart intervals along the form to provide structural reinforcement for the form.

The preferred embodiment of the present invention includes a highly precise ninety degree edge designated by reference number 68 to accommodate high accuracy concrete finishing requirements. A form having a high accuracy ninety degree form edge is known as an Arris form. The distance between form base 12 and precision edge 68 may be closely controlled during manufacture to provide an absolute distance reference between the subgrade surface 34 and edge 68. Edge-base form spacing tolerances of plus or minus one thirty-second of an inch can be achieved without difficulty. By machine milling the edges 68 of each form 10, a zero inch tolerance can be achieved when required to produce close tolerance concrete flooring known as superflat floors.

As illustrated in FIGS. 1, 2, 8A and 8B, the concrete form 10 of the present invention can be used to support the bridge 72 of a material topping spreader of the type disclosed in U.S. Pat. No. 4,349,294 and in co-pending allowed U.S. patent application Ser. No. 311,674, filed Oct. 15, 1981, which are both hereby incorporated by reference. To properly track equipment rail 18 of the present invention, the bridge 72 of the material spreader is provided with translation units including flanged wheels 74 which engage the upper load bearing surface of equipment rail 18. In the preferred embodiment of the invention, the elevation of the upper surface of equipment rail 18 is precisely aligned with the upper edge 76 of the Arris form as illustrated in FIGS. 2 and 3. In this configuration, the upper surface of equipment rail 18 is precisely aligned with the desired elevation of the finished concrete surface and serves as a highly accurate elevation reference for various types of concrete finishing equipment such as a triangular truss vibratory concrete screed of the type disclosed in FIG. 1 of U.S. Pat. No. 4,316,715 (Allen), a high density concrete placer of the type disclosed and claimed in U.S. Pat. No. 4,314,733 (Allen), or with a concrete spreading and finishing device of the type disclosed and claimed in U.S. Pat. No. 4,466,757 (Allen).

In the predecessor material spreader system, each end of the spreader bridge was supported by paired rubber tires positioned outboard of conventional concrete forms and rolled along on exposed dirt. Some difficulty was experienced in maneuvering the spreader wheels over the ground beside the pour area since that surface may be severely obstructed by spilled concrete, rebar, chuck holes, form braces and various other structures creating a highly irregular, non-uniform surface. Spreader operators have experienced difficulty in manually maneuvering the predecessor spreader bridge along the pour and in maintaining one end of the spreader bridge aligned with the opposing end to distribute the topping material in parallel strips.

Figure 8B:
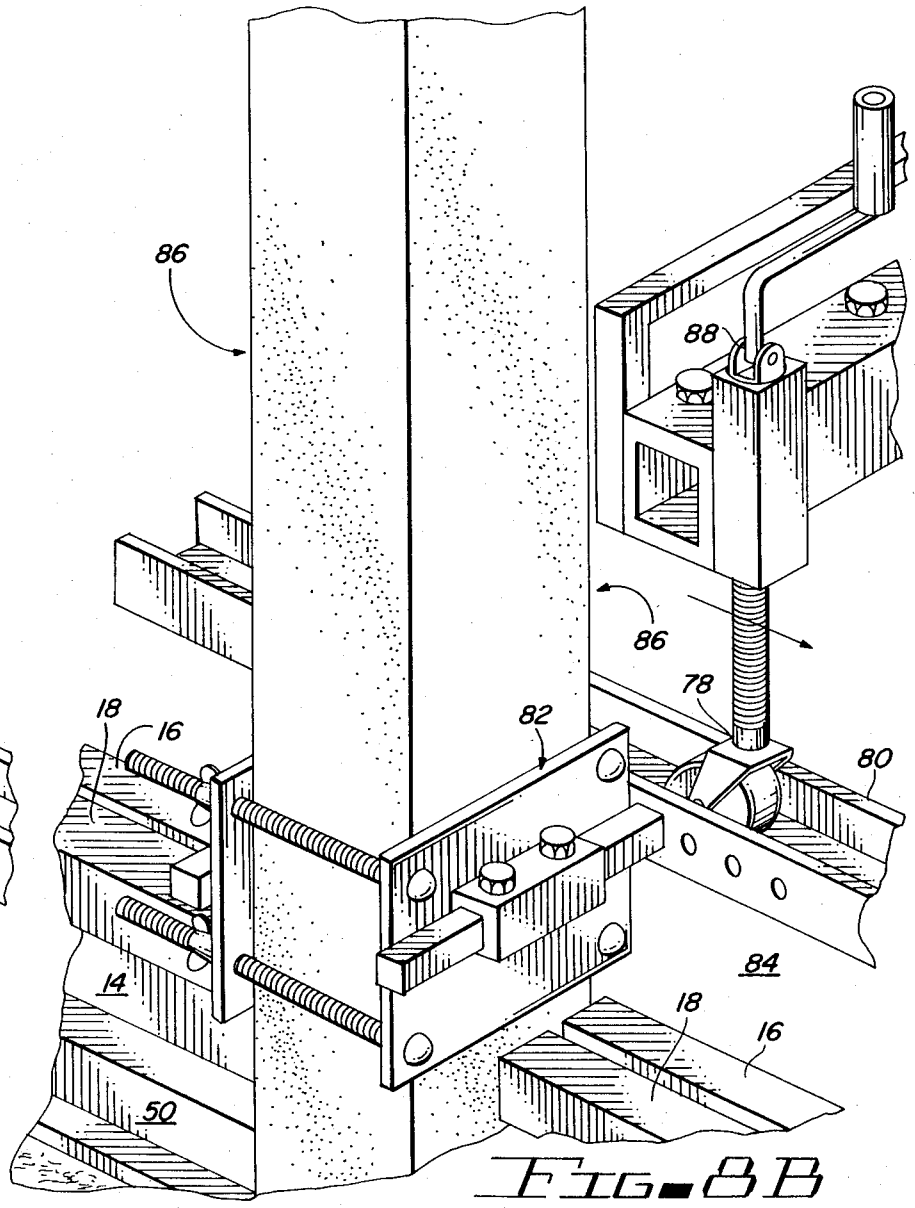
FIGS. 8A–B depict the manner in which the lightweight form plus equipment rail of the present invention is used in combination with a material spreader system and its column bracket accessory for providing a smooth, level load bearing surface at the edge of a concrete pour area for supporting, guiding and translating the spreader bridge along the length of the pour and past vertically extending obstructions in the form of columns.
Figure 8A:
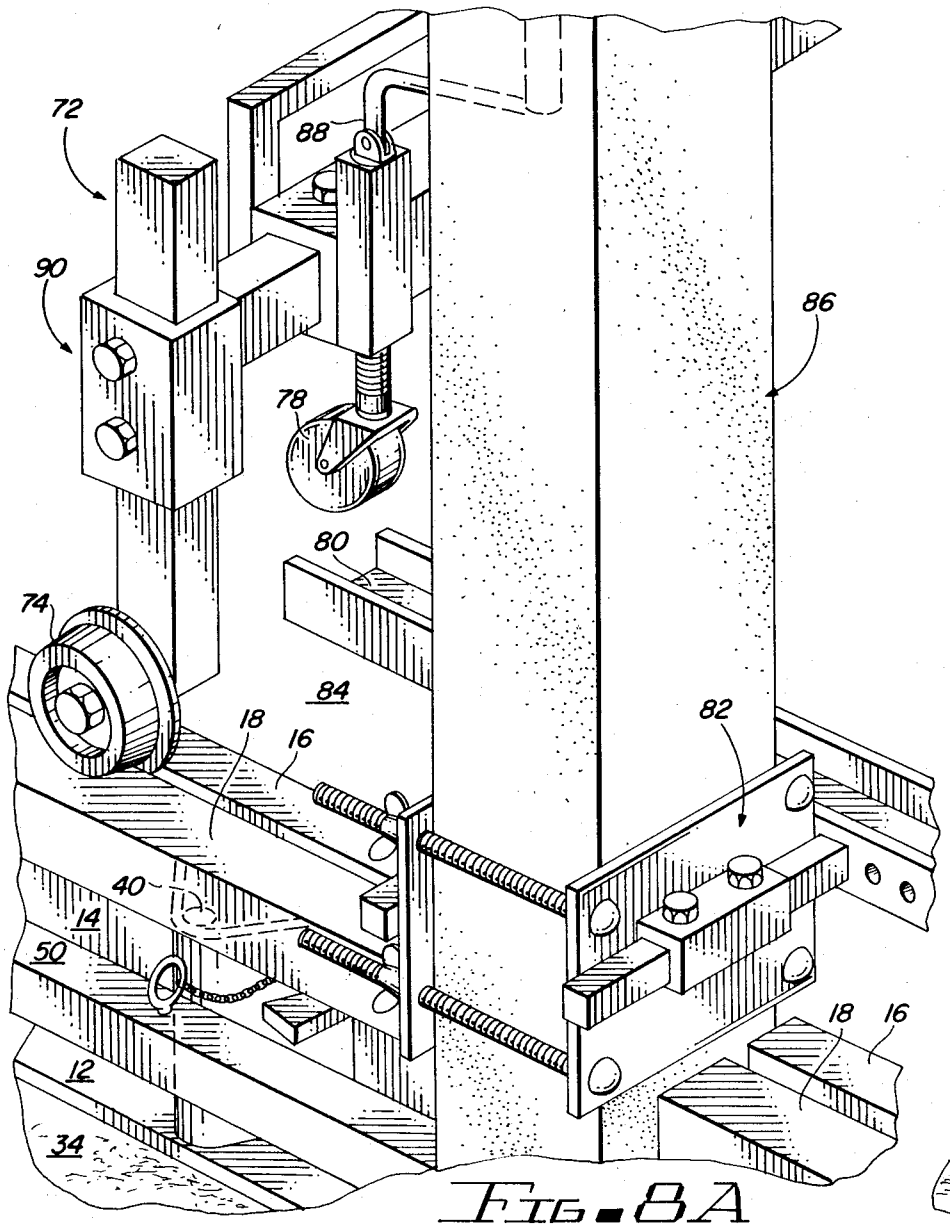

In sharp contract, the lightweight concrete form depicted in FIGS. 8A and 8B includes parallel, unobstructed equipment rails 18 on opposite sides of the pour area providing a level, low friction path for supporting opposite ends of the spreader bridge 72. The desired perpendicular bridge/form alignment can easily be maintained as the spreader is manually translated along the length of the concrete pour. When track 80 of column bracket 82 is approached, the operator actuates screw jack assembly 88 and displaces secondary wheels 78 directly into track 80. Once set, the spacing between primary wheels 74 and secondary wheels 78 need not be changed as the spreader bypasses numerous columns 86 in a row of columns since the spacing between equipment rail 18 and track 80 remains constant. Once the load of the spreader bridge 72 has been transferred from primary wheel 74 to secondary wheel 78 by actuation of screw jack 88, the entire primary wheel support unit 90 is removed, permitting the decreased span length spreader bridge to be translated past column 86 as depicted in FIG. 8B. After secondary wheel 78 has been translated past column 86, primary wheel support unit 90 is reinserted into the end of spreader bridge 72 and screw jack 88 is actuated to transfer the weight of the spreader bridge from the track 80 of column bracket 82 back to the equipment rail 18. The translation of the spreader system along the level, smooth equipment rail 18 can then promptly be resumed to complete the topping spreading operation in a time substantially shorter than that attainable with the rubber wheeled predecessor spreader system.

Complete and more detailed drawings of the variable span spreader bridge and the column bracket are included in allowed U.S. patent application Ser. No. 311,674. The structure of those elements depicted in FIGS. 8A and 8B has been simplified for the purpose of this explanation.

Upon completion of the concrete finishing operations, concrete form 10 is removed from the edge of the concrete pour, disassembled into its component parts and carried from the job site to a truck by laborers. The lightweight structure of the present invention provides a man-portable system and eliminates the requirement for cranes or other heavy lifting equipment which has been essential for the use of prior art equipment rail forms.

Figure 9:
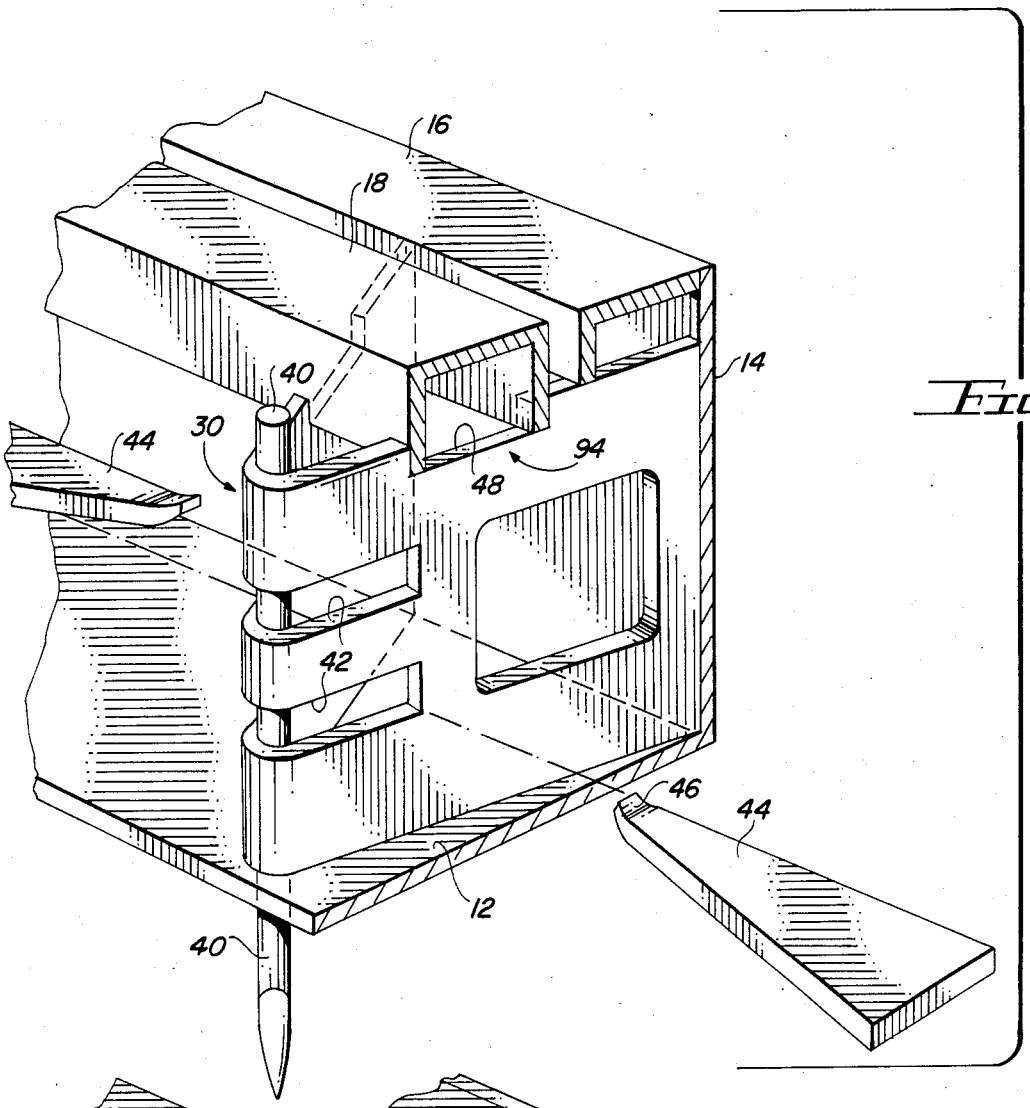
FIG. 9 depicts an alternative embodiment of the invention where the equipment rail spacing means and load transfer means are combined in a single element and the stake which secures the form to the underlying subgrade is positioned outboard of the equipment rail.

Referring now to FIG. 9, another embodiment of the present invention is illustrated. In this embodiment, rail alignment bracket 20 and load bearing bracket 22 have been combined into a single bracket assembly 92 which includes an upper surface including a single slot 94. Slot 94 includes vertically oriented sides for receiving the vertically oriented sides of equipment rail 18. The horizontally oriented lower surface of slot 94 provides a load bearing surface for transferring the load of equipment rail 18 and any forces imposed on the equipment rail through the structure of bracket 92 to the base 12 of concrete form 10 and then to subgrade 34 Bracket 92 also includes a V-shaped channel having an apex 30 for receiving stakes 40 as described above. Wedges 44 extend through apertures 42 for clamping stake 40 to bracket 92. Because stake 40 passes through this embodiment of the form outside of rail overlap zone 48, no particular sequence of assembly of the equipment rail 18 and stake 40 must be followed as was the case with the other embodiment of the invention. It is not necessary that the upper surface of stake 40 be driven below the upper surface of bracket 92.

Figure 10:
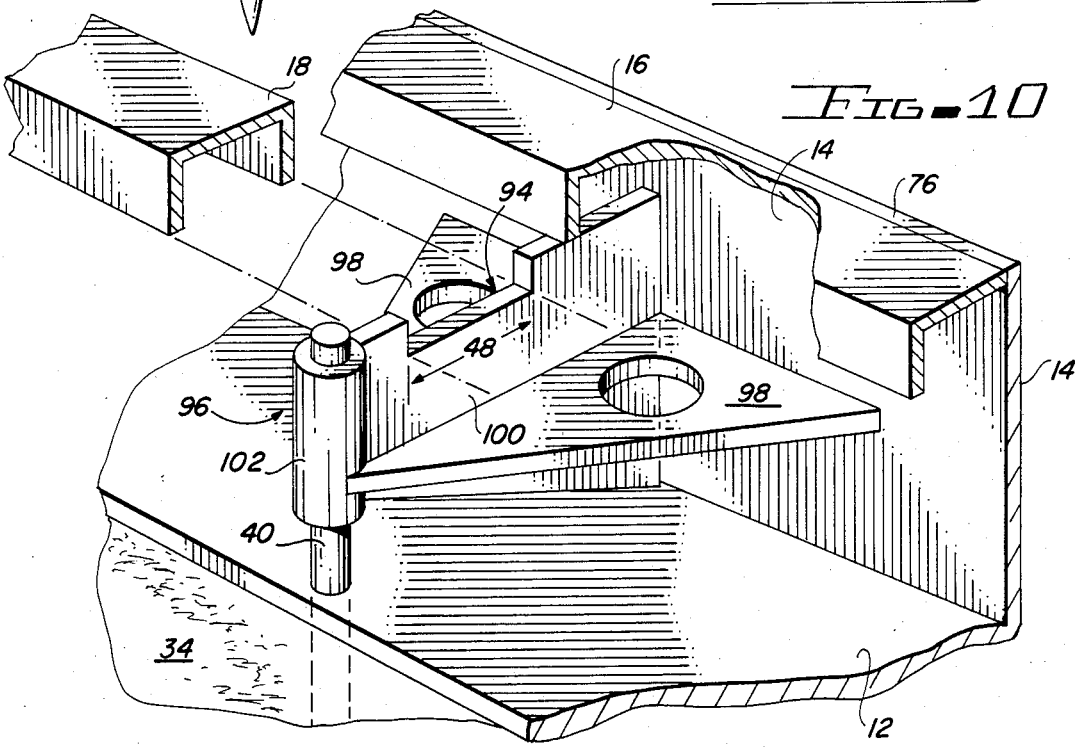
FIG. 10 is another embodiment of the present invention having characteristics similar to those depicted in the FIG. 9 embodiment.

Referring now to FIG. 10, another embodiment of the present invention is illustrated. This form 96 includes a load bearing bracket 100 fabricated from a single vertical plate welded to the form face and braced by gussets 98. A single slot 94 maintains an equipment rail in a fixed position with respect to the form and transfers loads to the form base. A tubular housing 102 receives stakes and secures the form to the subgrade.

It will be apparent to those skilled in the art that the disclosed lightweight concrete form including a detachable equipment rail may be modified in numerous other ways and may assume many other embodiments different from the preferred forms specially set out and described above. Accordingly, it is intended by the appended claims to cover all such modifications of the invention which fall within the true spirit and scope of the invention.

I claim:

1. A concrete form comprising:

a. a horizontal base for contacting an underlying subgrade;

b. a vertical face joined to said base for shaping the edge of an area of plastic concrete;

c. an equipment rail having a linear load bearing upper surface, a width, first and second substantially vertical side surfaces and a lower surface;

d. rail coupling means for loosely coupling said equipment rail to said form to permit immediate assembly or disassembly of the equipment rail/-form assembly by substantially vertical, non-rotational relative displacements of said rail with respect to said rail coppling means, including i. horizontal spacing means contacting the first and second side surfaces of said equipment rail at at least two spaced apart first locations along said rail for maintaining a fixed horizontal spacing between said rail and said vertical form face without transferring significant vertical loads between said horizontal spacing means and said rail, said horizontal spacing means maintaining a closely abutting, loose contact with the first and second side surfaces of said equipment rail, the overlap between said equipment rail and said form base defining a rail overlap zone on said base equal in width to the rail width; and ii. load transfer means extending across the rail overlap zone and loosely supporting said equipment rail from below at at least two spaced apart second locations along the length of said rail spaced part from the first locations for maintaining the load bearing surface of said equipment rail parallel to said form base and for transferring vertical loads imposed on said equipment rail to said form base;

e. form securing means for rigidly securing said form to the subgrade including i. stake penetration means for enabling a plurality of spaced apart stakes to be driven through said base into the subgrade to secure said stakes to the subgrade; and ii. stake securing means for rigidly securing said stakes to said form.

2. The concrete form of claim 1 wherein said equipment rail includes lower horizontally extending surfaces and said horizontal spacing means includes horizontally extending surfaces and wherein said horizontal spacing means is dimensioned to maintain a gap between the lower horizontally extending surfaces of said equipment rail and the upper horizontally extending surfaces of said horizontal spacing means to avoid transfer of vertical loads from said equipment rail to said horizontal spacing means.

3. The concrete form of claim 1 wherein said equipment rail is fabricated in the form of a U-shaped channel member having a first vertical leg including first and second side surfaces and a spaced apart second vertical leg including third and fourth side surface.

4. The concrete form of claim 3 wherein a first slot in said horizontal spacing means engages the first and second side surfaces of the first leg of said U-shaped channel member.

5. The concrete form of claim 4 wherein said horizontal spacing means further includes a second slot spaced apart from said first slot for engaging the third and fourth side surfaces of the second leg of said U-shaped channel member.

6. The concrete form of claim 2 wherein said stake securing means secure said stakes to said load transfer means.

7. The concrete form of claim 2 wherein said stake penetration means enables said stakes to be driven through said form base at least partially within the rail overlap zone.

8. The concrete form of claim 7 wherein said stake penetration means enables said stakes to be driven through said form base within the rail overlap zone.

9. The concrete form of claim 1 wherein said horizontal spacing means is laterally offset from said load transfer means.

10. The concrete form of claim 9 wherein said load transfer means comprises a V-shaped bracket having a vertically oriented apex for receiving a single stake, first and second legs having ends secured to said vertical form face, and a base secured to said form base.

11. The concrete form of claim 10 wherein said load transfer means further includes clamping means for rigidly securing each of said stakes to the apex and first and second legs of each of said V-shaped brackets.

12. The concrete form of claim 1 wherein said horizontal spacing means includes a slotted rail alignment bracket.

13. The concrete form of claim 12 wherein said rail alignment bracket is coupled to said vertical form face.

14. The concrete form of claim 13 wherein said rail alignment bracket includes a lower surface elevated above said form base.

15. The concrete form of claim 14 wherein said rail alignment bracket includes an upper surface positioned below the linear load bearing upper surface of said equipment rail.

16. The concrete form of claim 13 wherein said load transfer means includes an upper surface and wherein the first and second legs of said U-shaped channel member contact the upper surface of said load transfer means.

17. The concrete form of claim 16 wherein said horizontal spacing means includes a lower surface extending below the upper surface of said load transfer means.

18. The concrete form of claim 17 wherein the upper surface of each of said stakes is situated level with or below the upper surface of said load transfer means.

19. The concrete form of claim 14 wherein said horizontal spacing means includes a plurality of rail alignment brackets coupled at spaced apart intervals along the length of said concrete form.

20. The concrete form of claim 19 wherein said load transfer means includes a plurality of load transfer brackets coupled at spaced apart intervals along the length of said concrete form.

* * * * *